United States Patent [19]

Hoppe

[11] Patent Number: 4,819,810

[45] Date of Patent: Apr. 11, 1989

[54] SCREENING MACHINE WITH FLOATING ECCENTRIC SHAFT

[75] Inventor: Kurt Hoppe, Hilden, Fed. Rep. of Germany

[73] Assignee: Hein, Lehmann AG, Dusseldorf, Fed. Rep. of Germany

[21] Appl. No.: 135,514

[22] Filed: Dec. 18, 1987

Related U.S. Application Data

[63] Continuation of Ser. No. 882,275, Jul. 7, 1986, abandoned.

[30] Foreign Application Priority Data

Jul. 12, 1985 [DE] Fed. Rep. of Germany ..... 3524895

[51] Int. Cl.[4] ..... B07B 1/28

[52] U.S. Cl. ..... 209/315; 209/326; 209/382

[58] Field of Search ..... 209/310, 311, 315, 325, 209/326, 346, 365.1, 365.3, 365.4, 366.5, 382, 396

[56] References Cited

U.S. PATENT DOCUMENTS

| | | | |
|---|---|---|---|
| 1,534,892 | 4/1925 | Beaumont | 209/315 X |
| 1,600,792 | 9/1926 | Bland | 209/315 X |
| 3,261,469 | 7/1966 | Wehner | 209/396 |
| 3,317,041 | 4/1967 | Century | 209/315 |
| 3,647,068 | 3/1972 | Wehner | 209/310 |
| 3,971,715 | 7/1976 | Wehner | 209/310 |
| 4,188,288 | 2/1980 | Wehner | 209/310 |
| 4,315,817 | 2/1982 | Popper | 209/315 |
| 4,319,993 | 4/1982 | Krause | 209/315 |
| 4,581,132 | 4/1986 | Fritz et al. | 209/310 |
| 4,600,506 | 7/1986 | Hoppe | 209/310 |

FOREIGN PATENT DOCUMENTS

| | | | |
|---|---|---|---|
| 365175 | 3/1973 | U.S.S.R. | 209/346 |
| 977054 | 3/1981 | U.S.S.R. | 209/310 |
| 487809 | 6/1938 | United Kingdom | 209/326 |

OTHER PUBLICATIONS

German publication, "Umbrex-Siebmaschinen Als Zweisystem-Maschinen", undated.

*Primary Examiner*—Robert B. Reeves
*Assistant Examiner*—Donald T. Hajec
*Attorney, Agent, or Firm*—Herbert Dubno

[57] ABSTRACT

A screening machine with two driven systems driven in circular oscillation by means of at least one eccentric shaft. The shaft is mounted on both frames simultaneously which are separated from one another and each of the frames comprises a plurality of crossmembers fastened parallel to one another to the respective pair of uprights. The crossmembers of the respective frames, lying in a respective screening plane, alternate with one another and are driven by the systems in a way resulting in a stretching and contracting motion of an elastic screen fastened to the crossmembers and, consequently, the screen material is cast from the surface of the screen.

5 Claims, 4 Drawing Sheets

SCREENING MACHINE WITH FLOATING ECCENTRIC SHAFT

This is a continuation of co-pending application Ser. No. 882,275 filed on July 7, 1986, now abandoned.

FIELD OF THE INVENTION

The invention relates to a screening machine with two systems driven in circular oscillation by means of at least one eccentric shaft. The oscillatable systems can comprise frames separated from one another or each consisting of two sides members with crossmembers fastened parallel to one another at regular intervals between the side member of each frame. The crossmembers lie in a respective screening plane and the crossmembers of the two systems alternate with one another and are driven by the systems in such a way that the elastic screen sections between the crossmembers and fastened to these are alternately stretched and contracted.

BACKGROUND OF THE INVENTION

A screening machine of this type is known from German Pat. No. 1,206,372. Reference may also be had to U.S. Pat. Nos. 3,971,715 and 4,600,506 in the regard. The mutually opposite side members of the two systems of movement have two driven eccentric shafts passing through them. The two ends of each shaft are mounted rotatably in a base frame. This additional base frame involves a high outlay in construction cost and means that the machine must be of a large overall size. Furthermore, considerable vibrational force must be absorbed by this base frame.

OBJECT OF THE INVENTION

The object of the invention is to provide a screening machine of the type described which is of simple construction and which has small external dimensions.

SUMMARY OF THE INVENTION

According to the invention, this object is achieved by providing that each eccentric shaft is mounted solely in the two movable systems, i.e. is not journaled on any base or otherwise stationary part.

The screening machine, therefore, does not require a base frame, so that it is substantially simpler in terms of construction. It can consequently be produced more inexpensively and, because there is not base frame, it has smaller external dimensions. The vibrations generated by the eccentric shaft or eccentric shafts do not have to be absorbed by a base frame (as required in the prior art) which has hitherto had to absorb a certain amount of energy. By contrast, the vibration energy is utilized completely by the systems of movement, so that less energy is required to screen the materials. Also, the construction of the invention is subject to less wear, since there is no need for outer bearings of the eccentric shaft on a fixed base which are subject to particularly high wear.

An especially reliable mounting and simple construction are obtained when a first of the two systems of movement is mounted resiliently on a second system of movement and the second system of movement is supported resiliently on the base, although the shafts are not journaled thereon.

Preferably only one eccentric shaft is provided and that the two systems of movement (oscillatory frames) are stabilized by means of supporting springs. Alternatively, two eccentric shafts can be mounted parallel to one another in the two systems of movement and one of the eccentric shafts can drive the other, e.g. via a coupling belt.

It is proposed, furthermore, that there be fastened to the side members of both frames above the first screening plane a second layer of crossmembers (alternately connected to one and the other oscillatory frame) which form a second screening plane (screen ceiling). As an alternative to this, it is proposed that a screening plane or a protective cover be fastened above the first screening plane to the frame or to the side member of one of the systems of movement.

BRIEF DESCRIPTION OF THE DRAWING

An exemplary embodiment of the invention is illustrated in the drawing and described in detail below. In the drawing:

FIG. 3 is a diagrammatic side view thereof.

SPECIFIC DESCRIPTION

Figure 1:
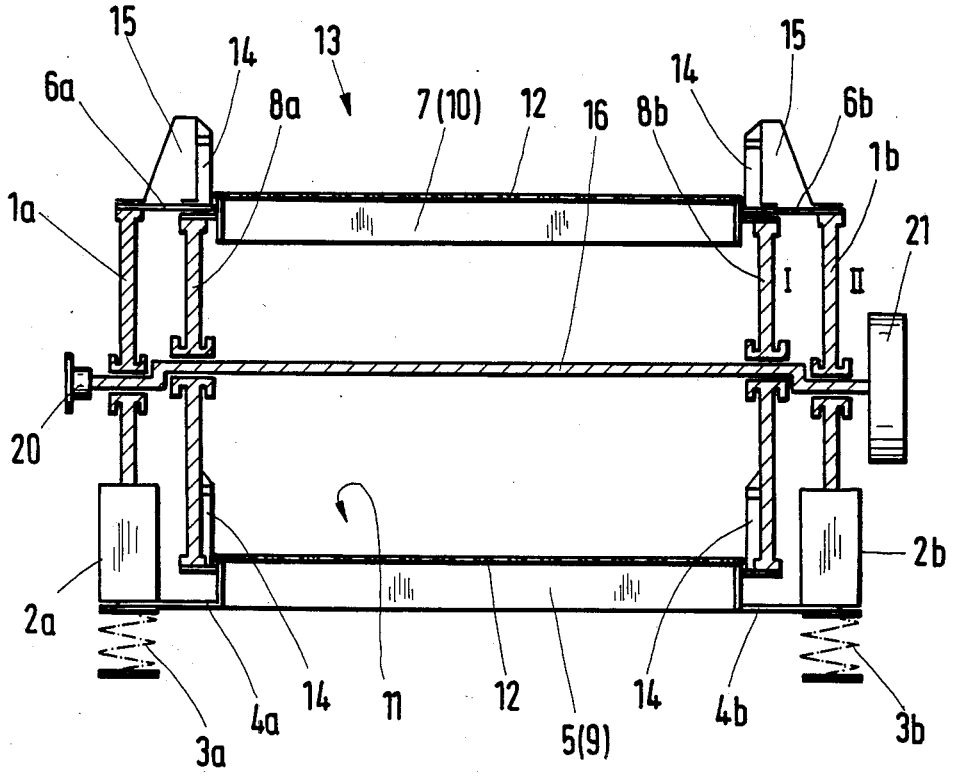
FIG. 1 is a diagrammatic vertical section through the screening machine transversely relative to the conveying direction of the screening material.

The outer system of movement or oscillatory frame II has two vertical side members (side walls) 1*a*, 1*b* which in the lower region are formed by a structural member of box section 2*a*, 2*b* mounted on the base via helical springs 3*a*, 3*b*.

Fastening elements 4*a*, 4*b* project inwards on the undersides of the box sections 2*a*, 2*b* and hold horizontal crossmembers 5. These crossmembers are perpendicular to the side members 1*a*, 1*b* transverse to the conveying direction of the screening material. In the same way, fastening elements 6*a*, 6*b* project inwardly at the top of the side members 1*a*, 1*b* and, to obtain a second screening plane arranged above the lower screening plane, hole crossmembers 7 which are parallel to the crossmembers 5.

Mounted between the side members 1*a*, 1*b* is a first system of movement or oscillatory frame I which in turn has two side members 8*a*, 8*b* parallel to the side members 1*a*, 1*b*. Crossmembers 9, 10 are fastened in the same way to the opposite sides and undersides of the side cheeks or side walls 8*a*, 8*b* and are parallel to the crossmembers of the system of movement II and are at the same height but alternate with crossmembers 5 and 7, respectively. The lower screen 11 therefore has approximately 12 to 16 crossmembers 5, 9 which are fastened alternately to one system of movement and to the other and which between them carry section of a flexible screen layer 12. The upper screen 13 is formed in the same way.

Figure 2:
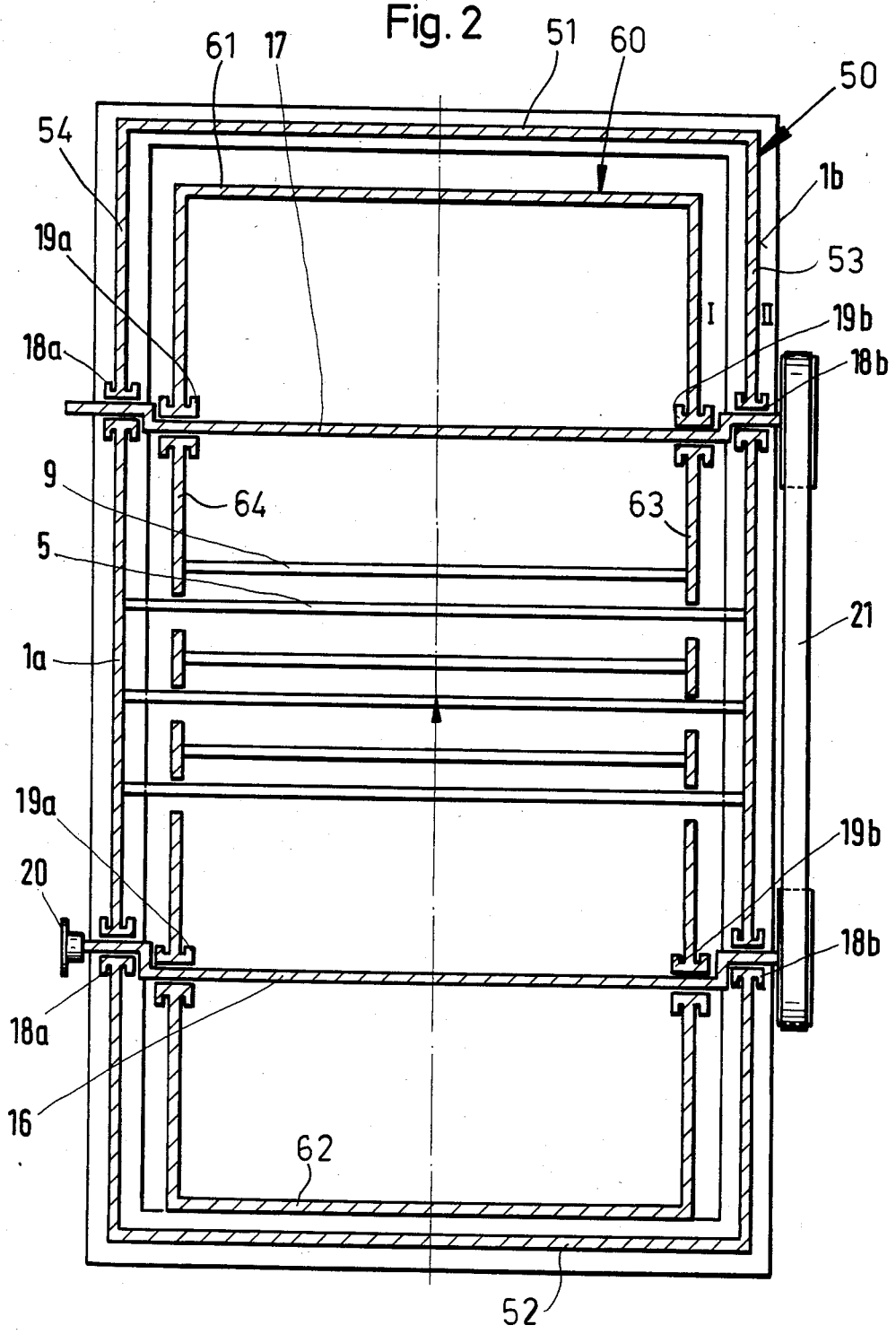
FIG. 2 is a diagrammatic plan view of the screening machine.

More specifically and as is clear from U.S. Pats. Nos. 4,600,506, and 3,971,715, the upper screen surface 12 of the upper screen 13 is connected to the bars 7 and 10 which alternated with one another while the lower screen surface 12 of the lower screen is attached to the bars 5 and 9 which alternate with one another. The side members 1*a*, 1*b* carry the longitudinal member 53, 54 of an outer frame 50 (movement system II) whose transverse members are seen at 51 and 52 (FIG. 2) The bars 5 span the members 53 and 54. The bars 9 are carried by the members 63 and 64 of an inner frame 60 (movement system I) whose transverse members are seen at 61, 62.

The lower screen 11 is limited laterally by the side members 8*a*, 8*b*, and a seal 14 of elastic material is fastened to these side members in the lower region. The upper screen 13 is limited by lateral supports 15 which are fastened to the side members 1*a*, 1*b* and which in turn carry seals 14.

Two eccentric shafts 16, 17 journaled at four points extend transvsersely to the conveying direction through the side members 1*a*, 1*b* 8*a*, 8*b* of the two systems of the movement I, II (oscillating framaes). The eccentric shafts 16, 17 are journaled in bearings 18*a*, 18*b* of the side members 1*a*, 1*b* at two outer regions and in bearings 19*a*, 19*b* of the side members 8*a*, 8*b* at inner regions. The eccentric shafts 16, 17 are offset twice, between the two bearings 18*a* and 19*a* and between the two bearings 18*b* and 19*b*, so that the axis of the eccentric shaft is the same for the bearings 18*a* and 18*b*, but is offset from parallel to the axis of the bearing 19*a* and 19*b*.

The eccentricity or throw is approximately 5 to 7 mm. Consequently, in the course of one revolution of the shaft, each point of each system oscillating frame is moved along a circular path of a diameter of approximately 14 mm. Since the two systems follow one another 180° out of phase, specific system points approach and move away from one another. As a result of this, as seen in a plan view, during one revolution of an eccentric shaft the crossmembers 9 of the system I move away from the crossmembers 5 of the system II and then approach them again. Consequently the web of screen-layer 12 located between two crossmembers 5, 9 is extended once and contracted once. The first eccentric shaft 16 is connected to an electric motor via a drive wheel 20, and the drive can take place directly or via V-belt transmission or by means of V-belt transmission with a cardan shaft. The second eccentric shaft 17 is driven by the first eccentric shaft 165 via a coupling belt 21.

Figure 2A:
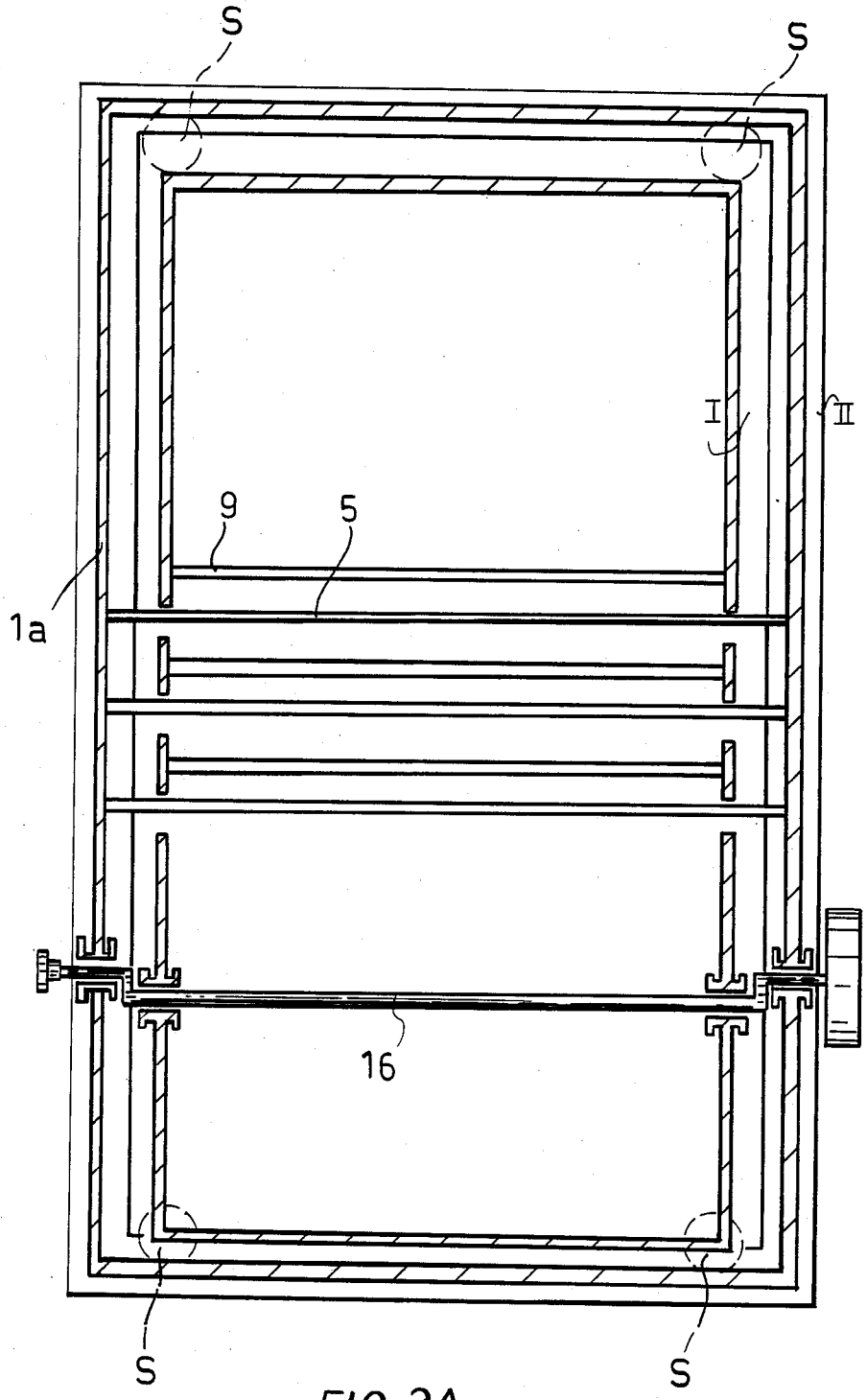
FIG. 2A is a view similar to FIG. 2 illustrating a modification of the invention.

Alternatively, the screening machine can be driven by a single eccentric shaft 16 (FIG. 2A), in which case the systems are stabilized by means of additional supporting springs. Instead of the double-screen design illustrated, the machine can also have only a single screen level. Furthermore, it is possible to fasten above such a single screen level a protective cover which is carried by the side cheeks of one of the two systems of movement.

I claim:

1. A screening machine, comprising:

a base;

a first frame resiliently mounted on said base and supported only by resilient means on the base for oscillatory movement relative to said base, said first frame including:

a pair of side members, and a plurality of uniformly spaced first crossmembers lying perpendicular to and spanning said side members of said first frame and defining a screening plane;

a second frame oscillatory movable relative to said first frame and supported only thereon, said second frame including:

a pair of side members parallel to the side members of said first frame, and a plurality of uniformly spaced second crossmembers alternating with said first crossmembers generally in said plane and spanning the side members of said second frame;

a flexible screen layer affixed to said first and second crossmembers so that webs of said layer between a first and a second crossmember are alternately stretched and contracted upon relative oscillatory displacement of said first and second frames; and oscillating means mounted and journaled exclusively on said frames and free from any journal on said base for effecting relative oscillatory displacement of said first and second frames, said oscillating means including two generally parallel spaced apart eccentric shafts, each of said eccentric shafts extending transversely to said side members, each of said eccentric shafts being journaled to the side members of said first frame about a respective first axis and journaled to the side members of said second frame about a respective second axis parallel to the respective first axis as the exclusive journals of each of said eccentric shafts, and means coupling said eccentric shafts for joint rotation.

2. The screening machine defined in claim 1 wherein said means coupling said eccentric shafts for joint rotation is a coupling belt.

3. The screening machine defined in claim 1, further comprising:

third substantially equispaced crossmembers on said side members of said first frame bridging same and lying in a second screen plane above said first screen plane;

fourth substantially equispaced crossmembers alternating with said third crossmembers substantially in said second plane and bridging said side members of said second frame; and an upper screen layer affixed to said third and fourth crossmembers.

4. The screening machine defined in claim 1, further comprising a cover spacedly overlying said screen plane and carried by at least one of said frames.

5. A screening machine, comprising:

a base;

a first frame resiliently mounted on said base and supported only be resilient means on the base for oscillatory movement, said first frame including:

a pair of side members, and a plurality of uniformly spaced first crossmembers lying perpendicular to and spanning said side members of said first frame and defining a screening plane;

a second frame oscillatorily movable relative to said first frame and supported only thereon, said second frame including:

a pair of side members parallel to the side members of said first frame, and a plurality of uniformly spaced second crossmembers alternating with said first crossmembers generally in said plane and spanning the side members of said second frame;

a screen layer affixed to said first and second crossmembers so that webs of said layer between a first and a second crossmember are alternately stretched and contracted upon relative oscillatory displacement of said first and second frames;

oscillating means mounted for effecting relative oscillatory displacement of said first and second frames and consisting of a single eccentric shaft extending transversely to said side members and journaled to said side members of said first frame about a first axis and journaled to the side members of said second frame about a second axis parallel to said first axis such that journals of said eccentric shaft on said side members are the only journals of said eccentric shaft for said machine and said eccentric shaft is not otherwise supported apart from on said frames; and additional springs acting upon said frames for stabilizing same.

* * * * *